United States Patent [19]

Konno et al.

[11] Patent Number: 4,678,313

[45] Date of Patent: Jul. 7, 1987

[54] ELECTROPHOTOGRAPHIC RECORDING APPARATUS

[75] Inventors: Tetsuro Konno; Yutaka Kanai; Tetsuya Fujita, all of Tokyo, Japan

[73] Assignee: Seikosha Co., Ltd., Tokyo, Japan

[21] Appl. No.: 863,599

[22] Filed: May 15, 1986

[30] Foreign Application Priority Data

May 15, 1985 [JP] Japan ..... 60-103137
May 15, 1985 [JP] Japan ..... 60-103139

[51] Int. Cl.[4] ..... G03G 15/00
[52] U.S. Cl. ..... 355/3 R; 355/16; 101/DIG. 13
[58] Field of Search ..... 355/3 R, 3 P, 12, 16, 355/77; 430/31, 40; 101/DIG. 13

[56] References Cited

U.S. PATENT DOCUMENTS 3,804,620 4/1974 Wells ..... 355/3 P

*Primary Examiner*—Richard L. Moses
*Attorney, Agent, or Firm*—Bruce L. Adams; Robert E. Burns; Emmanuel J. Lobato

[57] ABSTRACT

Disclosed is an electrophotographic recording apparatus comprising a pair of toner containers for accommodating a toner, a photosensitive member constituted by a transparent substratum, a transparent electrode and a photoconductive layer, a light irradiating means for irradiating this photosensitive member with light such as a laser beam from the transparent substratum side (rear surface side) thereof, and a transfering means. With this apparatus, an area required for the photosensitive device can be made small, a long durable life of the photosensitive member can be ensured, and no special toner is required.

5 Claims, 13 Drawing Figures

ELECTROPHOTOGRAPHIC RECORDING APPARATUS

BACKGROUND OF THE INVENTION

1. Field of the Invention

The present invention relates to an electrophotographic recording apparatus for use in copiers, facsimile equipment, optical printers, etc.

2. Prior Art

As a mainstream of conventional electrophotoelectric processes, zerography is known, which is basically divided into six processes. In other words, these six processes comprise a first process or charging a photosensitive device, a second process for exposing the photosensitive device by irradiating the same with light so as to form an electrostatic latent image, a third process for causing a toner to be adhered to the electrostatic latent image of this photosensitive device to effect development, a fourth process for transferring this development onto recording paper by making use of an electric field, a fourth process for fixing the image transferred onto the recording paper, and a six process for cleaning the toner remaining on the photosensitive device. Individual devices for effecting the first to fourth processes and the six process are disposed separately along a drum-like photosensitive device having a relatively large diameter or a sheet like photosensitive device, while a device for effecting the fifth process is disposed midway in a passage of transporting the recording paper (e.g., refer to R. M. Schaffert ("Electrophotography", published by The Focal Press (London and New York)).

In addition, as for the development device for the third process, a complicated mechanism requiring rotary mechanism parts having high precision, such as a magnet roll and a development sleeve have been employed (e.g., refer to Japanese Patent Publication No. 12148/1982).

As another method, there has been proposed a method whereby a transparent electrode is formed on a transparent substrate, such as glass, recording paper and a rear electrode plate are disposed in opposing and parallel relation thereto, a photoconductive toner layer charged on the transparent electrode is formed or transported, and charges are made to escape from the charged photoconductive toner to the transparent electrode by applying light from the rear surface of the transparent electrode, thereby transferring this selected toner to the recording paper and forming a visible image thereon (e.g., Japanese Patent Laid-Open No. 101424/1978).

In an apparatus based on the known zerography process, it is necessary to especially dispose devices for each process, so that the apparatus becomes complicated and large in size, which makes it difficult to make the apparatus thin and compact. Furthermore, the mechanism of the development device is complicated, and the toner during the development process comes into contact with the surface of the photosensitive device at a fast speed and causes friction therewith, thereby exerting an adverse effect on the life of the photosensitive device.

With respect to another method described above, there is a problem in that a special toner must be used which can be obtained by mixing zinc oxides, cadmium sulfide, etc. exhibiting photoconductive characteristics together with a binder, and such magnetic powders as magnetite at high temperature and by pulvering the mixture by means of a ball mill.

The present applicant has earlier proposed a novel electrophotographic process capable of substantially reducing the number of processes under Japanese Patent Application No. 99369/1985. An object of the present invention is to provide an electrophotographic recording apparatus which meets this method, requires a smaller area for a photosensitive device, is designed to prolong the life of the photosensitive device, requires no special toner, and is capable of easily effecting the charging of the toner.

SUMMARY OF THE INVENTION

To this end, an electrophotographic recording apparatus according to the present invention comprises a pair of toner containers for accommodating a toner, a photosensitive member constitued by a transparent substratum, a transparent electrode, and a photoconductive layer, a light irradiating means for irradiating this photosensitive member with light such as a laser beam from the transparent substratum side (rear surface side) thereof, and a transferring means. Both of the toner containers are provided at openings provided facing each other with a pair of electrode plates to which a voltage for charging the toner delivered from the opening is applied and which has a function of adjusting the thickness of the toner. The photosensitive member is arranged such as to face at a lower portion of the toner container distal end of each of the electrode plates with a predetermined gap therebetween and such as to be reciprocably movable back and forth. The reciprocating movement of this photosensitive member causes the toner inside the toner containers to be charged on the surface of the photoconductive layer of the photosensitive member by means of the electrode plates so as to be supplied with a uniform thickness. As the toner on the light irradiated portion is charged into an opposite polarity to the original charge through a selected photoconductive layer whose electric resistance has decreased after being subjected to the irradiation of light by means of the light irradiating means as well as the transparent electrode, the selected toner which as been charged into the opposite polarity is transferred directly onto the recording medium by means of the transferring means.

DESCRIPTION OF THE PREFERRED EMBODIMENTS

Before describing the preferred embodiments of the present invention, the basic principle of an electrophotographic process relating to the present invention will be described with reference to FIG. 1.

Figure 1:
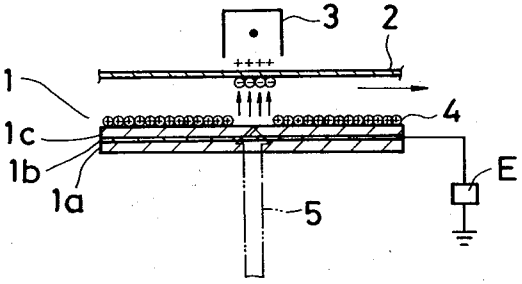
FIG. 1 is a view explaining the basic principles of an electrophotographic process which is applied to the present invention.
Figure 4:
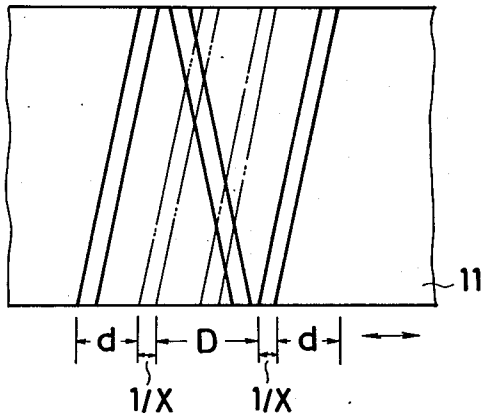
FIG. 4 is a view explaining the relationship between the transporting speed of the photosensitive device and the scanning of the light.

In FIG. 1, a photosensitive member 1 has a three-layer structure, and a transparent electrode 1*b* is formed on the upper surface of a transparent substratumla, such as glass, while a photoconductive layer 1*c* is formed on the upper surface of this transparent electrode 1*b*. A redording medium 2, such as ordinary paper, is positioned with a slight gap between the surface of a photoconductive layer 1*c*. A charging device 3 such as a corona discharger which constitutes a transferring means is disposed on the rear surface of the recording medium 2. A charged toner 4, i.e., a positively charged toner in this example, is uniformly adhered to the surface of the photosensitive member 1. Upon application of light 5, such as a laser beam, from the rear side of the photosensitive member 1, i.e., from the side of the transparent substratumla, the electric resistance of the photoconductive layer 1*c* subjected to the irradiation with light decreases, and negative charges are injected into that portion of the toner via the photoconductive layer 1*c* and the the transparent electrode 1*b* biased to negative voltage. The selected toner into which charges of opposite polarity is directly transferred onto the recording medium 2 via the charger 3, which is one example of the transferring means.

Figure 2:
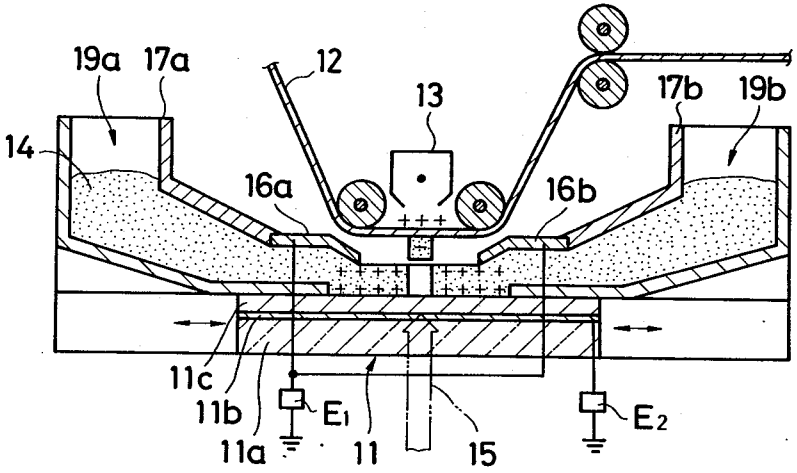
FIG. 2 is a cross-sectional view illustrating a preferred embodiment of the present invention.

FIG. 2 shows one preferred embodiment to which the aforementioned basic principle is applied.

A photosensitive member 11 is of planar shape, and is constituted by the three layers of a transparent substratum 11*a*, a transparent electrode 11*b*, and a photoconductive layer 11*c*, as in the case of the aforementioned example. A pair of electrode plates 16*a*, 16*b* are provided on the surface of the photosensitive member 11 with a predetermined gap therebetween. The electrode plates 16*a*, 16*b* are fixed in the openings of wall 17*a*, 17*b* constituting a pair of toner containers 19*a*, 19*b* for accommodating a toner 14. The distal end of the electrode plates 16*a*, 16*b* have a predetermined gap with the photoconductive layer 11*c* and have a function of adjusting the thickness of the toner layer. A recording medium 12 is provided such as to be conveyed horizontally from the left to the right such as to be opposed to the photosensitive member 11, while a charger 13 is disposed on the rear surface of the recording medium 12. A positive voltage is applied to the electrode plates 16*a*, 16*b* via a power source $E_1$, while a voltage of opposite polarity is applied to the transparent electrode 11*b* via a power source $E_2$.

The photosensitive member 11 is adapted to be capable of reciprocating back and forth, and the toner accommodated in the toner containers 19*a*, 19*b* is supplied to the surface of the photoconductive layer 11*c* by passing below the electrode plates 16*a*, 16*b* by virtue of the weight of the toner itself and the aforementioned reciprocal motion. Since a voltage is applied to the electrode plates 16*a*, 16*b* via the power source $E_1$, the toner 14 is positively charged by coming into contact with these electrode plates. The surface of the photosensitive member 11 attracts the toner as the charges of opposite polarity are induced by the charges of the toner 14. In addition, the toner 14 on the surface of the photosensitive member 11 assumes a uniformly thin layer as the photosensitive member reciprocates back and forth below the electrode plates 16*a*, 16*b*. When light 15, such as a laser beam, is applied from the rear surface side of the photosensitive member 11 immediately below the charger 13 by means of the light-irradiating means during the movement of the photosensitive member 11 from the left to the right, the toner 14 on this light irradiated portion is transferred onto the recording medium 12 by means of the charger 13 as has been explained with respect to the basic principle. Although the toner 14 on the photosensitive member 11 disappears partially by this transfer, this portion of disappearance is corrected again to a uniform layer as said portion passes below the electrode plate 16b located on the right-hand side and moves again from the right to the left. Furthermore, since the photosensitive member 11 is reciprocating, the light beam 15 does not scan the same portion of the photosensitive member 11, so that the optically induced fatigue of the photosensitive member can be reduced.

Figure 3:
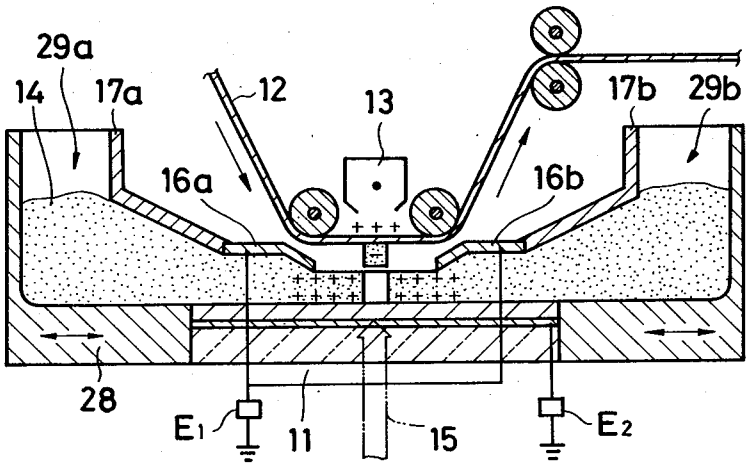
FIG. 3 is a cross-sectional view in another embodiment.

FIG. 3 shows another embodiment of the present invention. In this embodiment, the photosensitive member 11 is disposed such as to be embedded in the center of the bottom of a box-like substrate 28 constituting toner containers 29*a*, 29*b*. The photosensitive member 11 is of the same three-layer structure as that of the aforementioned substantially identical parts as those of the example shown in FIG. 1. When recording, the photosensitive member 11 reciprocates to the left and the right together with the toner containers 29*a*, 29*b*.

The photosensitive member 11 thus reciprocates, so that, when the moving direction is inversed, there is a case where the toner 14 after being transferred and adhered to the recording medium may be inverted and reach the position for retransfer before the toner containers are replenished. Therefore, in the present invention, to ensure that the same position will not be scanned by the light 15 in such a case, the application of the light 15 is adapted such that light-scanning is effected intermittently at intervals when the photosensitive member 11 moves in one direction, and that when the photosensitive member 11 is inverted and moves in the opposite direction, light-scanning is effected for the interval between a given position and another for scanning with light during movement in the aforementioned one direction. In addition, the transporting speed of the recording medium 12 is set in such a manner that the recording medium 12 advances by the width of only one line until the following light-scanning.

An examination will be made hereinafter of the conditions for continuous image recording at the time when the photosensitive member reciprocates in a case where a laser beam is made to scan using a polygon scanner (not shown) as the light irradiating means.

If the scanning image angle of the polygon scanner and the effective scanning angle actually contributing to the irradiation of the photosensitive member surface are equal and the photosensitive member is continuously fed, and if the distance from the starting position of scanning with light to the terminating position of light-scanning, i.e., the distance of advance while the width of the photosensitive member is scanned, is assumed to be d mm, while the time required for scanning the width of the photosensitive member is assumed to be T sec., the transporting speed of the photosensitive member becomes d/T mm/sec. If the degree of resolution is x pcs. per millimeter, the width of one line (dot pitch) becomes 1/x mm. If it is assumed that a light scanning period is NT sec, and that a distance from the terminating position of light-scanning for one line to the starting position of light-scanning for the next line is D mm, the conditions for not scanning the already scanned portion again when the moving direction of the photosensitive member 11 has been reversed can be expressed by the following formulae:

$$D \geqq d + 1/x \quad (1)$$

$$D = (N-1)d - 1/x \quad (2)$$

From (1) and (2), we have $$N \geqq 2(1 + 1/x \cdot d) \quad (3)$$

In a case where the photosensitive member advances by the width of one line during scanning of one line, the severest condition where the scanning picture angle of the polygon scanner and the aforementioned effective scanning image angle are equal is:

$d = 1/x$, and since $1/xd = 1$, from Formula (3), we have $$N \geqq 4.$$

Figure 5:
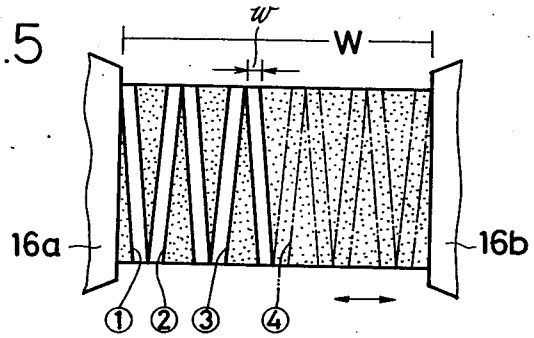
FIG. 5 is an explanatory view illustrating a locus in which light effects scanning over the photosensitive device.
Figure 6:
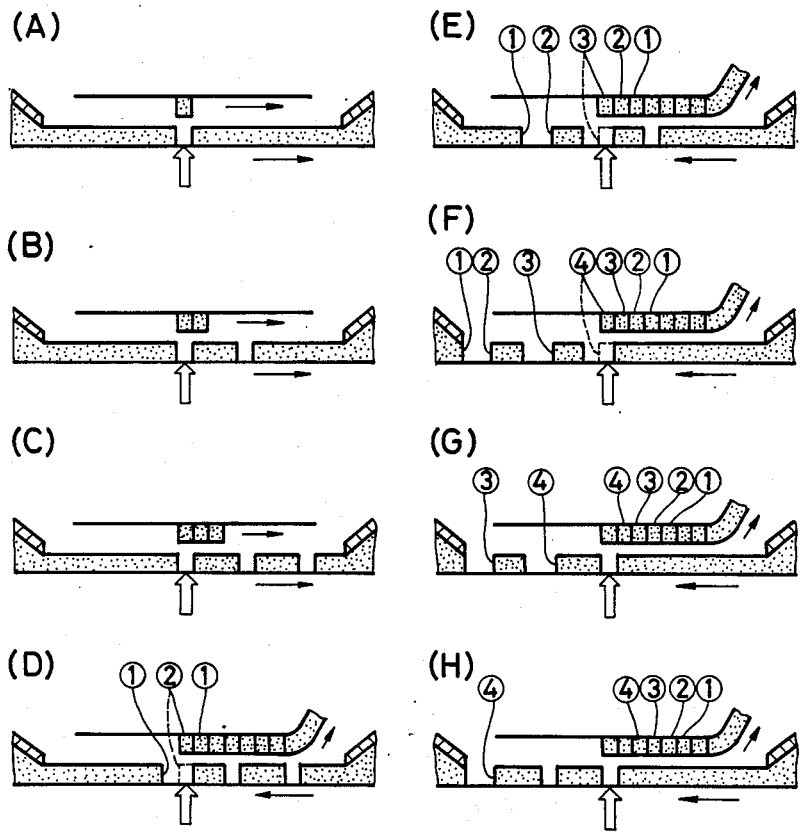
FIGS. 6 (A) to 6 (H) are explanatory diagrams illustrating the condition of the transfer of the toner.

Therefore, FIG. 5 shows a locus in which light is actually applied onto the photosensitive member surface during an inversion in a case where, under this severest condition, the moving speed of the photosensitive member 11 is set such that the photosensitive member 11 will move by the margin of the width of one line during the light-scanning of one line and light-scanning is not carried out for three lines after light-scanning of one line in terms of the intervals of light-scanning. In addition, FIG. 6 shows the state in which the toner is transferred onto the recording medium under the condition shown in FIG. 5. In other words, light-scanning is effected in FIG. 6 (A), transferring the toner for one line onto the recording medium. The photosensitive member moves rightward by an amount corresponding to the width of four lines, the toner for one line thereof is transferred (FIG. 6 (B)), and an amount corresponding to the width of four lines is further moved, thereby transferring the toner for that one line (FIG. 6 (C)). From this state, the photosensitive member moves rightward by an amount corresponding to the width of four lines, and a similar transferring operation is repeated. Subsequently, however, since the toner transferred in FIG. 6 (A) enters below the electrode plate **16*b* and the toner is replenished from the toner container 19*b*, the configuration of the toner does not change from the state shown in FIG. 6 (C). After the toner of the line (1) in a state shown in FIG. 6 (C) has been transferred, the photosensitive member moves rightward by an amount corresponding to the width of one line, and the state in which the toner of the line (2) rightwardly of the line (1) after inverting here and moving to the left-hand side by two lines is FIG. 6 (D). In view of timing with the light-scanning, this time should preferably correspond to a normal portion of four lines. Should this time be delayed, there will emerge a case in which the toner transferred in this portion is partially missing on the recording medium. In FIG. 6 (E), the toner for the line (3) is transferred, the toner for the line (4) is transferred as the photosensitive member moves leftward by an amount corresponding to the width of three lines (FIG. 6 (F)), and at a position (FIG. 6 (G)) where the toner is transferred as the photosensitive member moves leftward by an amount corresponding to the width of four lines, the transferring positions for the lines (1) and (2) enter below the electrode plate 16*a*, with the result that the toner is replenished from the toner container 19*a*. Furthermore, at a position (FIG. 6 (H)) where the toner is transferred as the photosensitive member moves leftward by an amount corresponding to the width of four lines, the transferring position of the line (3) is also located in the toner container 19*a*. As these steps are repeated, the transferring positions subsequent to the line (4) are also located in the toner container 19*a*, so that the toner is replenished. When the photosensitive member finally moves leftward by an amount corresponding to the width of 4n lines, and moves to the right-hand side inverting again, the state of the toner is such that it is bilaterally symmetrical as compared with that shown in FIG. 6 (D). Therefore, as already explained before, the adjacently located toner is transferred without overlapping the toner position where the immediately preceding transfer has been effected. Since the photosensitive member 11 carres out such reciprocating motion, if an interval between the electrode plates 16*a*, 16*b* is assumed to be W and the line width to be w, a minimum of(W+w)is required as the distance for permitting movement of the photosensitive member 11. Accordingly, it is necessary for the length of the photosensitive device 11** to be greater than (2W+w).

The toner is continuously supplied positively onto the surface of the photosensitive member at a position in which light-scanning is thus carried out, and an area where the toner is present is scanned with light during an inversion.

As explained above, an electrophotographic recording apparatus according to the present invention, in comparison with the known zerography process, has a fewer number of processes, does not require a complicated developing device hitherto in use, so that the apparatus can be made quite simple and it is readily possible to make the apparatus compact and thin. In addition, since a special toner is not required, the charging of the toner can be effected with ease, so that the toner can be readily supplied onto the surface of the photosensitive member in a uniform, thick layer. Moreover, since the light irradiating position is varied owing to the reciprocating motion, the photosensitive member is less liable to be subjected to optically induced fatigue, so that a long durable life can be ensured. Furtheremore, at the time of inversion of the moving direction of the photosensitive member, the transfer of the toner can be effected properly by setting the timing of light-scanning, the transporting speed of the recording medium, and the moving speed of the photosensitive member in such a manner as not to effect light-scanning by overlapping the the same light-scanning position as the previous one.

What is claimed is:

1. An electrophotographic recording apparatus comprising:

a pair of toner containers for accommodating a toner;

a pair of electrode plates which are disposed in openings in both of said toner containers opening such as to face each other, to which voltage for charging the toner delivered from said openings is applied, and which has a function of adjusting the layer of said toner;

a photosensitive member disposed such as to oppose at a lower portion of both of said toner containers the distal end of both of said electrode plates with a predetermined gap therewith and constituted by a transparent substratum, a transparent electrode, and a photoconductive layer, said photosensitive layer being reciprocated to the left and the right, and said toner in said toner containers, after being charged by said electrode plates, being supplied in a uniform thickness onto the surface of said photoconductive layer of said photosensitive member by virtue of the reciprocating movement of said photosensitive member;

light irradiating means for applying light from the side of said transparent substratum of said photosensitive member, the toner in a portion irradiated with light being charged to a polarity opposite to that of the initial charges via a selected photoconductive layer whose electrical resistance has decreased by being subjected to light irradiation by said light irradiating means as well as said transparent electrode; and transferring means for causing said selected toner charged to opposite polarity to be transferred onto a recording medium opposed to the toner adhered to the surface of said photoconductive layer.

2. An electrophotographic recording apparatus according to claim 1, wherein said photosensitive member constitutes a portion of the bottom of both of said toner containers and is adapted such that said photosensitive device and both of said toner contaners are reciprocated together.

3. An electrophotographic recording apparatus according to claim 2, wherein said photosensitive member is of planar shape.

4. An electrophotographic recording apparatus according to claim 1, wherein the light-irradiation by means of said light-irradiating means is adapted such that scanning is carried out intermittently at intervals when said photosensitive member moves in one direction, scanning is carried out for an interval of light-scanning in the aforementioned one direction when the aforementioned photosensitive member moves in the opposite direction, and the transporting speed of said photosensitive member is such as to advance said photosensitive member by the width of one line until the next scanning by said light-irradiating means.

5. An electrophotographic recording apparatus according to claim 1, wherein said photosensitive member is of planar shape.

* * * * *